US007317389B2

(12) United States Patent
Yokota

(10) Patent No.: US 7,317,389 B2
(45) Date of Patent: Jan. 8, 2008

(54) AUDIO APPARATUS AND MONITORING METHOD USING THE SAME

(75) Inventor: Teppei Yokota, Chiba (JP)

(73) Assignee: Sony Corporation (JP)

( * ) Notice: Subject to any disclaimer, the term of this patent is extended or adjusted under 35 U.S.C. 154(b) by 354 days.

(21) Appl. No.: 11/113,874

(22) Filed: Apr. 25, 2005

(65) Prior Publication Data

US 2005/0253713 A1 Nov. 17, 2005

(30) Foreign Application Priority Data

May 17, 2004 (JP) ..... P2004-145855

(51) Int. Cl.
*G08B 21/00* (2006.01)

(52) U.S. Cl. ..... 340/540; 340/541; 340/545.2; 340/539.23; 381/163

(58) Field of Classification Search ..... 340/540, 340/541, 545.2, 539.23; 381/163
See application file for complete search history.

(56) References Cited

U.S. PATENT DOCUMENTS 4,052,720 A * 10/1977 McGregor et al. ..... 340/522
4,529,973 A * 7/1985 Blamberg ..... 340/573.1
6,011,819 A * 1/2000 Shiro ..... 375/345

* cited by examiner

*Primary Examiner*—Jeffery Hofsass
*Assistant Examiner*—Samuel J Walk
(74) *Attorney, Agent, or Firm*—Lerner, David, Littenberg, Krumholz & Mentlik, LLP

(57) ABSTRACT

An audio apparatus includes a converter having a sound-output mode in which the converter functions as a sound-output device for converting a sound signal into an audio output and a sound-pickup mode in which the converter functions as a sound-pickup device for converting an audio signal into a sound output, a controller switching the converter to the sound-output mode or the sound-pickup mode, an analyzing section analyzing the sound output generated from the converter that is switched to the sound-pickup mode by the controller, and an alarm section generating an alarm signal based on an analysis result from the analyzing section.

34 Claims, 9 Drawing Sheets

AUDIO APPARATUS AND MONITORING METHOD USING THE SAME

CROSS REFERENCES TO RELATED APPLICATIONS

The present invention contains subject matter related to Japanese Patent Application JP 2004-145855 filed in the Japanese Patent Office on May 17, 2004, the entire contents of which are incorporated herein by reference.

BACKGROUND OF THE INVENTION

1. Field of the Invention

The present invention relates to an audio apparatus and a monitoring method using the same. More specifically, the present invention relates to an audio apparatus equipped with at least a speaker for reproducing a sound signal, such as a stereo audio system, a television receiver, or a personal computer, and to a monitoring method using the audio apparatus.

2. Description of the Related Art

With the increasing interest in anti-crime and disaster-prevention activities, a variety of home security systems for protection of homes have been developed and proposed. For example, Japanese Unexamined Patent Application Publication No. 2003-023441 discloses a system for reporting the visit of any pre-registered person to a portable telephone terminal of a user via a wide area network, such as the Internet, when the user is away from home. Japanese Unexamined Patent Application Publication No. 2002-373384 discloses a home security system using a wide area network, namely, a CATV transmission network, to monitor a plurality of dwelling units across a wide area.

SUMMARY OF THE INVENTION

Generally, home security systems are made up of a variety of equipment including sensors, such as human sensors for intruder detection, temperature sensors or smoke sensors for fire detection, and gas sensors serving as gas leakage detectors, and devices such as video cameras. Some home security systems further include door phones equipped with cameras, microphones, speakers, bell buttons, etc.

Setting up a home security system is therefore costly and requires extensive construction. The demands for low-cost, high-reliability home security systems for dwelling units without requiring extensive construction have increased.

It is therefore desirable to provide an audio apparatus that realizes a low-cost, high-reliability security system and a monitoring method using the audio apparatus.

Most audio apparatuses in rooms in houses are not used when no one is in the rooms. In most houses, audio apparatuses equipped with speakers, such as television receivers, personal computers, and compact disc (CD) players, are installed in every room, and, recently, television receivers, speakers for outputting music, etc., have increasingly been installed in various places, such as kitchens and bathrooms. These audio apparatuses are not used when no one is at home.

An audio apparatus according to an embodiment of the present invention includes the following elements. A converter has a sound-output mode in which the converter functions as a sound-output device for converting a sound signal into an audio output and a sound-pickup function in which the converter functions as a sound-pickup device for converting an audio signal into a sound output. Control means switches the converter to the sound-output mode or the sound-pickup mode. Analyzing means analyzes the sound output generated from the converter that is switched to the sound-pickup mode by the control means. Alarming means generates an alarm signal based on an analysis result from the analyzing means.

In this audio apparatus, an audio converter originally serving as a sound-output device is switched to the sound-pickup mode by control means, and generates a sound output. This sound output is analyzed by analyzing means, and an alarm signal is generated by alarming means based on an analysis result.

The converter used as a sound-pickup device picks up sound, and the analyzing means analyzes the picked-up sound to detect an abnormal sound. The occurrence of abnormal sound can be reported. The converter is normally used as a sound-output device, or a speaker, thus achieving a typical audio apparatus, i.e., an audio reproduction apparatus.

The audio apparatus may further include switching means for inputting a mode switching command. When the user's absence is input through the switching means, the control means may switch the converter to the sound-pickup mode. The sound picked up by the converter functioning as a sound-pickup device is analyzed by the analyzing means, and an alarm signal is generated by the alarming means based on an analysis result.

When the user is away from home, an away mode is set by the switching means, and the converter is used as a sound-pickup device. The sound picked up by the converter is analyzed by the analyzing means to detect an abnormal sound, and the occurrence of abnormal sound is reported. When the user is at home, the away mode is canceled by the switching means, and the converter is used as a sound-output device, or a speaker, thus achieving a typical audio apparatus, i.e., an audio reproduction apparatus.

The audio apparatus may further include a human sensor determining the presence of a person in the vicinity of the audio apparatus. When the presence of no one is determined by the human sensor, the control means may switch the converter to the sound-pickup mode.

When the user's absence is determined by the human sensor, the converter is switched to the sound-pickup mode by the control means. The sound picked up by the converter functioning as a sound-pickup device is analyzed by the analyzing means, and an alarm signal is generated by the alarming means based on an analysis result.

After the user's absence is automatically detected in this way, the converter is used as a sound-pickup device, and the sound picked up by the converter is analyzed by the analyzing means to detect an abnormal sound. The occurrence of abnormal sound can be reported. When the user is at home, the converter is used as a sound-output device, or a speaker, thus achieving a typical audio apparatus, i.e., an audio reproduction apparatus.

The audio apparatus may further include switching means for inputting a mode switching command, and a human sensor determining the presence of a person in the vicinity of the audio apparatus. When the presence of no one is determined by the human sensor or when a mode switching command is input by the switching means, the control means may switch the converter to the sound-pickup mode.

When the user's absence is input through the switching means or when the user's absence is determined by the human sensor, the converter is switched to the sound-pickup mode by the control means. The sound picked up by the converter functioning as a sound-pickup device is analyzed by the analyzing means, and an alarm signal is generated by the alarming means based on an analysis result.

Thus, either when the user's absence is input by the user through the switching means or when the user's absence is determined by the human sensor, the converter is used as a sound-pickup device, and the sound picked up by the converter is analyzed by the analyzing means to detect an abnormal sound. The occurrence of abnormal sound can be reported. When the user is at home, the converter is used as a sound-output device, or a speaker, thus achieving a typical audio apparatus, i.e., an audio reproduction apparatus.

The audio apparatus may be formed of a terminal device and a server device.

In the audio apparatus, the terminal device and the server device may be connected via a communication network. The terminal device may include the converter and the control means, and the server device may include the analyzing means. The sound signal picked up by the converter of the terminal device functioning as a sound-pickup device may be transmitted to the server device via the communication network, and may be analyzed by the analyzing means of the server device.

In the audio apparatus formed of a terminal device and a server device that are connected via a predetermined network, the sound picked up by the converter of the terminal device is supplied to the analyzing means of the server device via the predetermined network for analysis.

During the user's absence, sound is monitored using the analysis function of the server device to monitor sound by analyzing the sound picked up by the terminal device. The ability of the server device to analyze the picked-up sound in detail to detect an abnormality reduces the load on the terminal device. If terminal devices are placed in individual rooms and are connected to one server device via a network, these rooms can be monitored based on sound using the individual terminal devices located in these rooms.

The audio apparatus may further include notifying means for notifying a user of the converter functioning as a sound-pickup device when the converter is switched to the sound-pickup mode by the control means.

When the user is away from home and the converter functions as a sound-pickup device, a user is notified of the converter functioning as a sound-pickup device by the notifying means.

This ensures that, for example, when the user returns, the user recognizes an away mode (or a monitoring mode) in which the converter of the audio apparatus has been used as a sound-pickup device. Then, the user can return to a normal operation mode (or a sound reproduction mode) from the monitoring mode to avoid undue violation of the user's privacy.

The audio apparatus may further include communicating means for reporting the alarm signal generated by the alarming means to a predetermined destination.

When the alarming means generates an alarm signal, the communication means reports the occurrence of abnormality to a predetermined destination, e.g., a portable telephone terminal of the user. The user can immediately know of the occurrence of abnormality and can take appropriate measures.

The audio apparatus may further include sound recording means for recording the sound signal picked up by the converter in a recording medium when the alarming means generates an alarm signal.

When the alarming means generates an alarm signal, the picked-up sound signal is recorded in a predetermined recording medium. The sound picked up during the occurrence of abnormality helps the user know of the situation.

In the audio apparatus, the analyzing means may analyze the sound signal by performing at least one of an operation to detect the level of the sound signal supplied to the analyzing means, an operation to detect a change in the level of the sound signal, an operation to perform pattern matching between the sound signal and a predetermined sound pattern, and an operation to detect a movement of the sound signal.

The analyzing means analyzes the sound signal by performing at least one of an operation to detect the level of the sound signal, an operation to detect a change in the level of the sound signal, an operation to perform pattern matching between the sound signal and a predetermined sound registered in advance, and an operation to determine whether or not a movement of the sound signal occurs. An appropriate analysis of the sound signal allows for detection of abnormalities.

When a plurality of terminal devices are connected to the server device, the server device may include signal request generating means for generating and transmitting a sound signal request to a given terminal device of the plurality of terminal devices when the alarming means generates an alarm signal. When the given terminal device receives the signal request, the converter may be switched to the sound-output mode by the control means, and may output sound corresponding to sound data supplied from the server device or sound data stored in the given terminal device.

That is, when the audio apparatus is formed of a plurality of terminal devices and a server device, the output request generating means generates and transmits an output request to one of the terminal devices when the alarming means of the server device generates an alarm signal. In the terminal device that has received the output request, the converter is switched to the sound-output mode by the control means, and the converter used as sound-output device outputs sound. The converters of the other terminal devices are still used as sound-pickup devices.

In response to the sound output from the terminal device that has received the output request, it is determined whether or not the abnormal sound moves based on the sound picked up by the other terminal devices. This allows for reliable detection of abnormal sound produced by a suspicious intruder.

The audio apparatus may include a plurality of converters. The control means may switch at least one of the plurality of converters to the sound-output mode and the remaining converters to the sound-pickup mode. The sound output from the converter functioning as a sound-output device is picked up by the converters functioning as sound-pickup devices, thereby checking for the sound-output function and the sound-pickup function of the audio apparatus.

The audio apparatus may include a plurality of converters individually supporting multiple channels, e.g., stereo two channels (right and left channels). One of the converters is switched to the sound-output mode and the other converters are switched to the sound-pickup mode by the control means, thus self-checking for the sound-output function and the sound-pickup function.

Thus, the audio apparatus can check for the sound-output function and the sound-pickup function by itself without using any other device. A failure in the sound-output function or the sound-pickup function can be immediately detected with accuracy and can be reported to the user, so that the user can take appropriate measures. A high-reliability audio apparatus can therefore be realized.

Therefore, when the user is away from home, the converter of the audio apparatus is used as a sound-pickup device, and the sound picked up by the converter is analyzed by the analyzing means to detect an abnormal sound. The occurrence of abnormal sound can be reported. A security system utilizing generation of sound can be realized. In addition, when the user is at home, the audio apparatus can be used as a typical sound reproduction apparatus without impairing the original sound reproduction function.

Moreover, an apparatus capable of detecting an abnormality based on the picked-up sound when the user is away from home can be configured with low cost without any additional sound-pickup devices for detecting an abnormality.

If the audio apparatus is formed of terminal devices and a server device that are connected via a network, a plurality of rooms can integrally be managed, and an abnormality can be detected based on the picked-up sound without placing a load on these terminal devices.

The picked-up sound can be analyzed in detail by detecting the level of the picked-up sound, detecting a change in the level of the picked-up sound, performing pattern matching between the picked-up sound and a pre-registered sound pattern, determining the movement of the picked-up sound, etc. This allows for reliable detection of abnormalities using picked-up sound.

The self-check ability of the audio apparatus to check for the sound-output function and the sound-pickup function allows for reliable detection of failures in the sound-output function or the sound-pickup function, so that the user can take appropriate measures.

DESCRIPTION OF THE PREFERRED EMBODIMENTS

An audio apparatus and a monitoring method according to an embodiment of the present invention will be described with reference to the drawings. In the following embodiment, the audio apparatus and the monitoring method are used in a home network system in which a client device placed in each room and a server device placed in a predetermined room are connected via a network.

Figure 1:
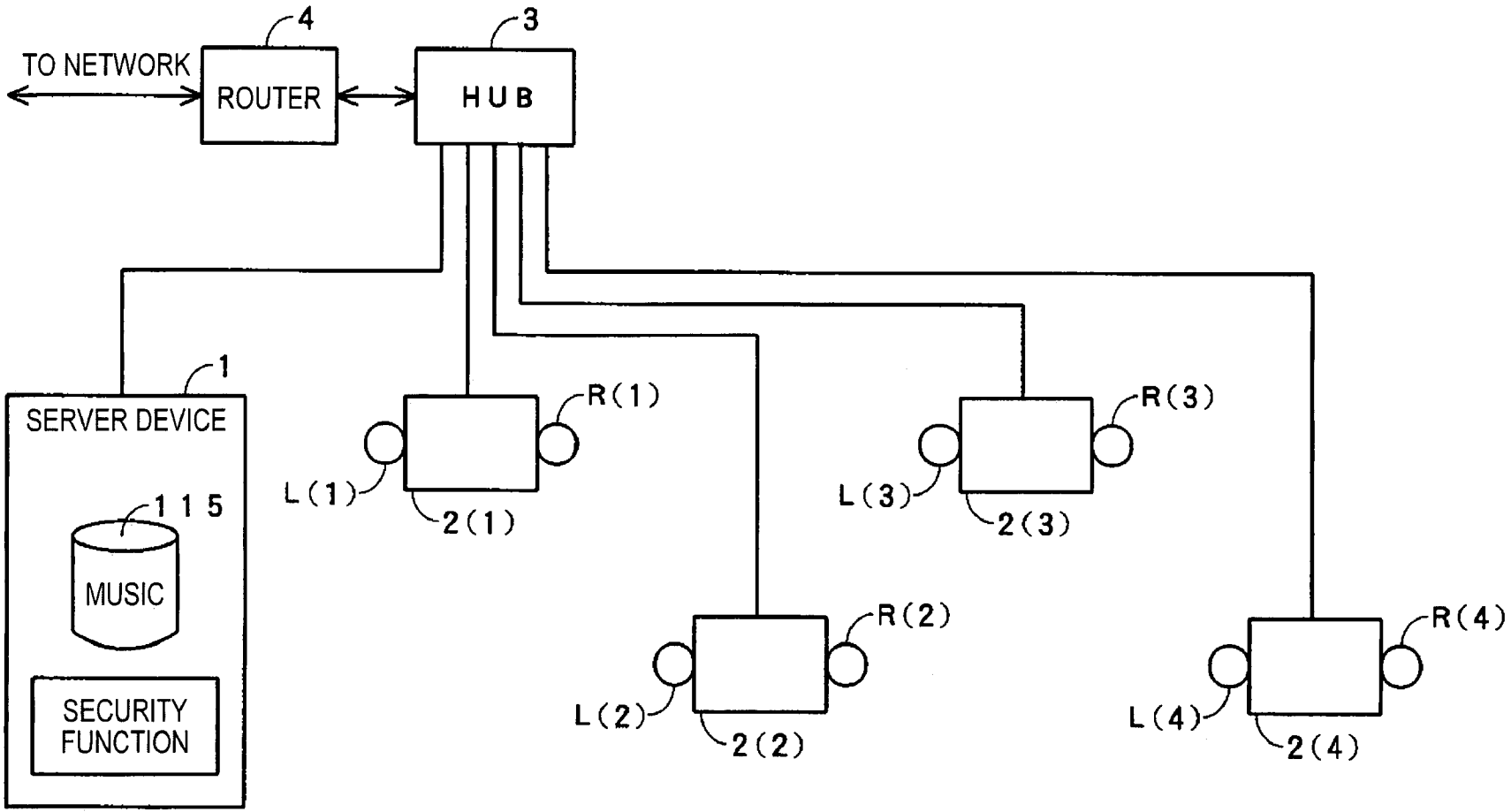
FIG. 1 is a schematic diagram of a home network system according to an embodiment of the present invention.

FIG. 1 illustrates the home network system according to the present embodiment. A server device 1 placed in a predetermined location in a house and client devices 2(1), 2(2), 2(3), and 2(4) placed in individual rooms in this house are connected via a hub 3 to form a local area network (LAN). The hub 3 is connected to a router 4, and the devices in the home network system, e.g., the server device 1, are connected to a wide area network, such as a telephone line or the Internet, via the router 4.

The server device 1 includes a large-capacity hard disk drive 115 storing music data (audio data) so that, in response to a request from the client device 2(1), 2(2), 2(3), or 2(4), the desired music data is distributed to the requesting client device, described in detail below.

The client devices 2(1) to 2(4) are similarly configured to send a request for the music data instructed by a user to the server device 1 and to receive the requested music data from the server device 1 to reproduce and output music corresponding to the music data from a speaker, described in detail below.

As shown in FIG. 1, each of the client devices 2(1) to 2(4) includes at least two-channel (right and left) speakers. Specifically, the client device 2(1) includes a left-channel speaker L(1) and a right-channel speaker R(1), the client device 2(2) includes a left-channel speaker L(2) and a right-channel speaker R(2), the client device 2(3) includes a left-channel speaker L(3) and a right-channel speaker R(3), and the client device 2(4) includes a left-channel speaker L(4) and a right-channel speaker R(4).

In the home network system (LAN system) according to the present embodiment, each of the client devices 2(1) to 2(4) and the server device 1 form an audio apparatus (music reproduction apparatus). The hard disk drive 115 of the server device 1 stores, for example, a large amount of music data that is distributed via the Internet and that is loaded from CDs, etc. The user can reproduce and listen to desired one of the music data stored in the server device 1 using any of the client devices 2(1) to 2(4) in any room.

Furthermore, in the home network system according to the present embodiment, each of the client devices 2(1) to 2(4) and the server device 1 cooperate to function as a monitoring system (or a home security system) when the user is away from home.

When the user is away from home, the speakers L(1), R(1), L(2), R(2), L(3), R(3), L(4), and R(4) of the client devices 2(1), 2(2) 2(3), and 2(4) are not used as sound-output devices performing the main function of the speakers, but are used as sound-pickup devices performing the opposite function.

The sound picked up by each of the speakers L(1), R(1), L(2), R(2), L(3), R(3), L(4), and R(4) serving as sound-pickup devices is analyzed to detect an abnormality, e.g., a suspicious person coming in a room, a window being broken, the occurrence of fire or earthquakes, etc., based on the analyzed sound. If an unusual sound is detected in an unoccupied room, it is determined that an abnormality occurs, and the abnormality is reported to a portable telephone terminal of the user who is away from home or to a pre-registered destination via a wide area network.

Therefore, when the audio data reproducing function is not enabled because the user is away from home, the home network system according to the present embodiment functions as a monitoring system in which the speakers are used as sound-pickup devices to pick up environmental sound and the picked-up sound is analyzed to detect an abnormality.

Figure 2:
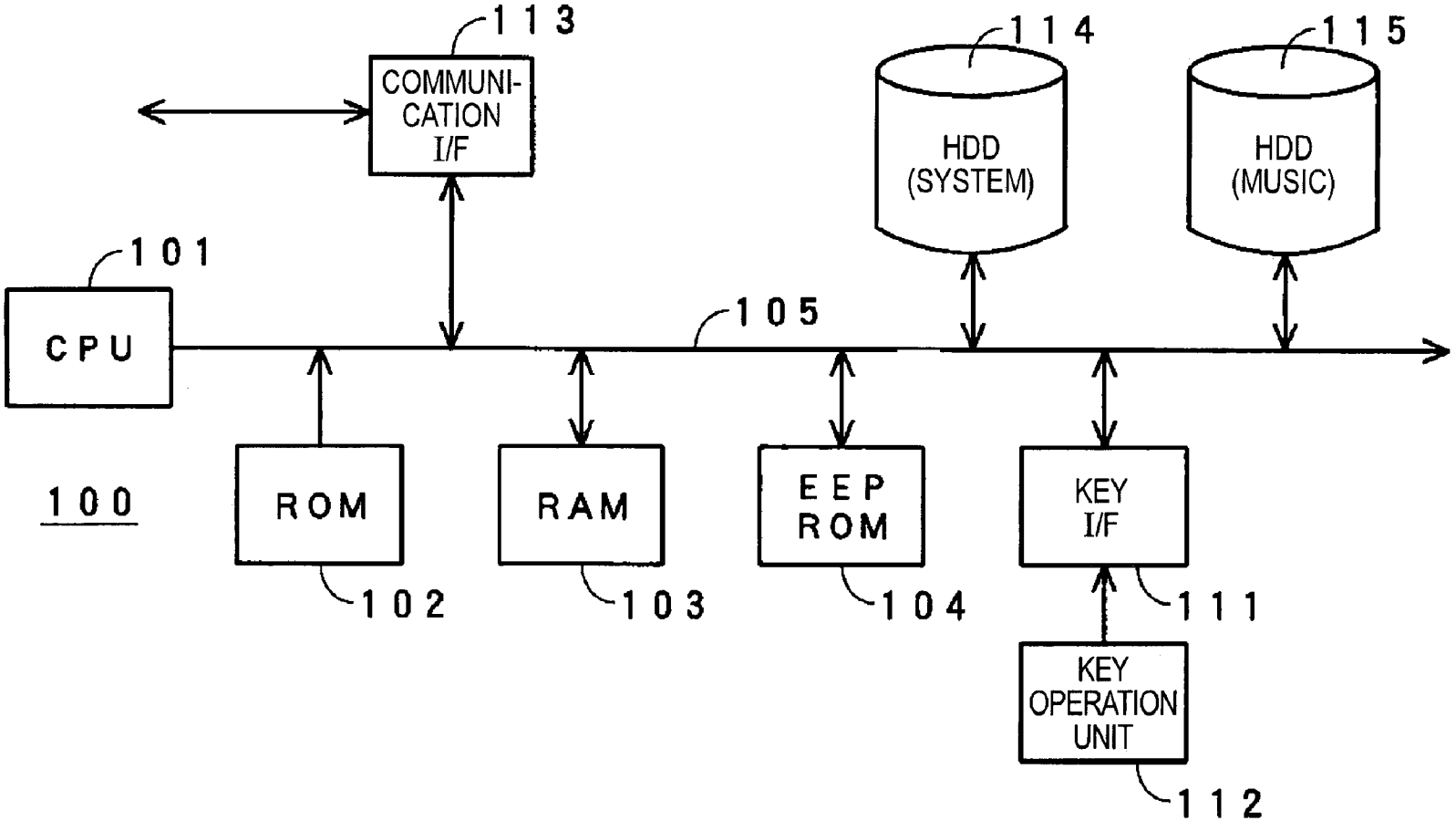
FIG. 2 is a block diagram of a server device 1 in the home network system shown in FIG. 1.

The configuration of the server device 1 in the home network system according to the present embodiment will be described. FIG. 2 is a block diagram of the server device 1 in the home network system according to the present embodiment.

Referring to FIG. 2, the server device 1 includes a controller 100, a key interface (I/F) 111, a key operation unit 112, a communication interface (I/F) 113, and hard disk drives (HDDs) 114 and 115.

As shown in FIG. 2, the controller 100 is a microcomputer for controlling the components in the server device 1, and includes a central processing unit (CPU) 101, a read-only memory (ROM) 102, a random access memory (RAM) 103, and an electrically erasable and programmable ROM (EEPROM) 104. These components are connected via a CPU bus 105.

The ROM 102 records a processing program, necessary data, etc., and the RAM 103 is mainly used as a work area. The EEPROM 104 is a non-volatile memory for storing data to be held even when the server device 1 is powered off, e.g., various types of setting information and parameters. The CPU 101 is a main control processor of the controller 100 for executing a program, receiving data, computing and modifying the data, recording the data in a memory, and controlling the components.

The key I/F 111 and the key operation unit 112 manipulate user operation inputs. The key operation unit 112 includes alphanumeric keys and function keys. The key operation unit 112 receives a user operation input through these operation keys, and supplies an electrical signal corresponding to the received user operation input to the key I/F 111.

The key I/F 111 generates an input signal of a format which can be supplied to the controller 100 based on the electrical signal from the key operation unit 112, and supplies the input signal to the controller 100. In response to the user operation input received via the key operation unit 112, the controller 100 controls the components.

The communication I/F 113 performs communication via the home network, and receives data via the home network. The communication I/F 113 converts the received data into data of a format which can be processed by the server device 1, and supplies the converted data to the controller 100. The communication I/F 113 also converts data that is supplied via the controller 100 and that is to be transmitted to any of the client devices 2(1) to 2(4) or the hub 3 connected via the home network, such as control data, requests, and music data, into a signal of a format which can be transmitted to the home network, and transmits the converted data to a target device via the home network.

The HDD 114 stores various processing programs and data necessary for realizing the server device 1 according to the present embodiment. The programs and data stored in the HDD 114 are read by the controller 100 for use, if necessary. The HDD 115 stores various kinds of music data, as described above.

Although the HDD 114 storing various programs and data for realizing the server device 1 and the HDD 115 storing various kinds of music data are separate, a single HDD may be divided into a system storage area and a content storage area. Alternatively, two or more different HDDs may be used.

Although not shown, for example, a liquid crystal display (LCD) having a relatively large display screen is connectable to the server device 1 to display information, such as guidance information and error information, to the user under the control of the controller 100. The server device 1 has external input and output terminals (not shown) for receiving information from an external device, e.g., music data, which is then stored in the HDD 115.

As described above, the server device 1 is connected to the Internet via the router 4 and the hub 3 to download music data free of charge or on payment from various server devices on the Internet, and stores the music data in the HDD 115. The server device 1 also stores in the HDD 115 music data that is supplied from an external device via the external input and output terminals (not shown).

When the server device 1 receives a request for music data from any of the client devices 2(1) to 2(4) via the communication I/F 113, the controller 100 retrieves the requested music data from the HDD 115, and supplies it to the communication I/F 113 so as to generate music data of a format which can be transmitted to the target client device, i.e., a transmission signal. The transmission signal is transmitted to the target client device via the home network.

When the server device 1 receives the picked-up sound (digital data) from the client devices 2(1) to 2(4) via the communication I/F 113, the controller 100 analyzes the received sound, and checks for the occurrence of unusual sound to detect an abnormality. When an abnormality is detected, the controller 100 is connected to a wide area communication via the communication I/F 113, the hub 3, and the router 4, and reports the abnormality to a predetermined destination such as a pre-registered portable telephone terminal of a user.

In this way, the server device 1 according to the present embodiment writes the distributed music data to the HDD 115 for storage, and also transmits (or distributes) music data requested by any of the client devices 2(1) to 2(4) connected to the home network system to the requesting client device.

Therefore, the server device 1 can download various types of data by connecting to, for example, a telephone network or the Internet via the home network, or can distribute the music data stored in the server device 1 to the client devices 2(1) to 2(4) in response to a request.

Moreover, as shown in FIG. 1, the server device 1 has a security function for analyzing the sound data (picked-up sound) transmitted from the client devices 2(1) to 2(4) to detect an abnormality. When an abnormality is detected, the abnormality is reported a pre-registered destination such as a portable telephone terminal of a user.

The configuration of the client devices 2(1) to 2(4) used in the home network system according to the present embodiment will be described. Since the client devices 2(1) to 2(4) used in the home network system according to the present embodiment have a similar configuration, the client devices 2(1) to 2(4) are referred to as a client device 2.

Figure 3:
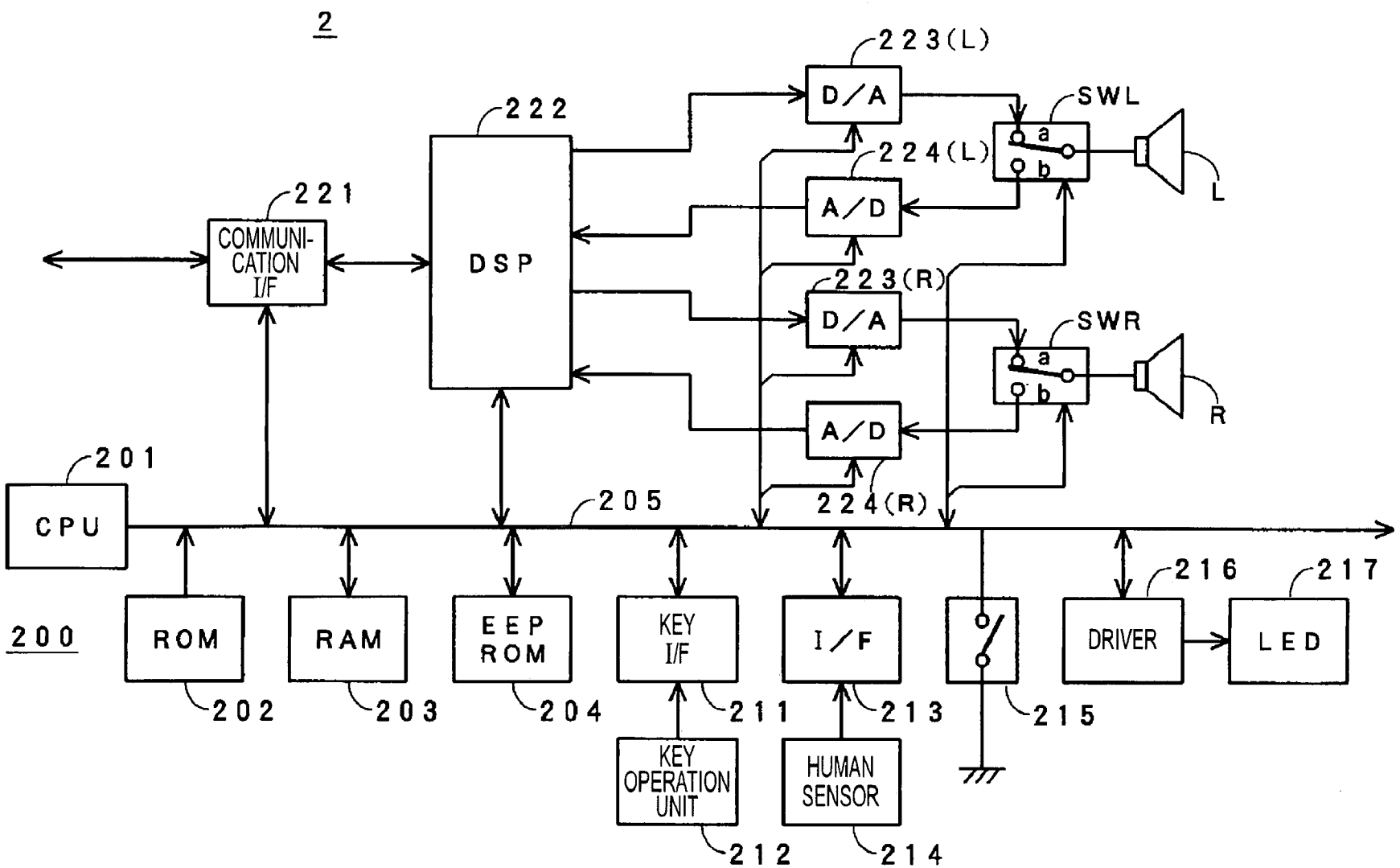
FIG. 3 is a block diagram of a client device 2 in the home network system shown in FIG. 1.

FIG. 3 is a block diagram of the client device 2 used in the home network system according to the present embodiment. As shown in FIG. 3, the client device 2 includes a controller 200, a key interface (I/F) 211, a key operation unit 212, a sensor interface (I/F) 213, a human sensor 214, an absence switching button switch (hereinafter referred to as an absence button) 215, a light emitting diode (LED) driver 216, an LED 217, a communication interface (I/F) 221, a digital signal processor (DSP) 222, digital-to-analog (D/A) converters 223(L) and 223(R), analog-to-digital (A/D) converters 224(L) and 224(R), switch circuits SWL and SWR, a left-channel speaker L, and a right-channel speaker R.

As shown in FIG. 3, the controller 200 is a microcomputer for controlling the components in the client device 2, and includes a CPU 201, a ROM 202, a RAM 203, and an EEPROM 204. These components are connected via a CPU bus 205.

The ROM 202 records a processing program, necessary data, etc., and the RAM 203 is mainly used as a work area. The EEPROM 204 is a non-volatile memory for storing data to be held even when the client device 2 is powered off, e.g., various types of setting information and parameters. The CPU 201 is a main control processor of the controller 200 for executing a program, receiving data, computing and modifying the data, recording the data in a memory, and controlling the components.

The key I/F 211 and the key operation unit 212 manipulate user operation inputs. The key operation unit 212 includes, for example, numeric keys and function keys. The key operation unit 212 receives a user operation input through these operation keys, and supplies an electrical signal corresponding to the received user operation input to the key I/F 211.

The key I/F 211 generates an input signal of a format which can be supplied to the controller 200 based on the electrical signal from the key operation unit 212, and supplies the input signal to the controller 200. In response to the user operation input received via the key operation unit 212, the controller 200 controls the components.

The human sensor 214 determines the presence or absence of the user. At least when the user's absence is determined, it is reported to the controller 200 via the sensor I/F 213. The sensor I/F 213 connects the human sensor 214 to the controller 200. The sensor I/F 213 converts a detection result from the human sensor 214 into a signal of a format which can be processed by the controller 200, and supplies the converted signal to the controller 200.

According to the present embodiment, the human sensor 214 detects infrared radiation generated from the human to determine whether or not a person (user) is in the room in which the client device 2 is placed.

The absence button 215 is operated by the user to switch the mode between presence (or home) and absence (or away). That is, the absence button 215 is toggled between the home mode and the away mode. The client device 2 according to the present embodiment is in the away mode when the absence button 215 is in an on state, and is in the home mode when the absence button 215 is in an off state. Thus, the absence button 215 functions as an entry receiving device for receiving an absence entry from the user.

The LED 217 is turned on and off by the LED driver 216 under the control of the controller 200. In the client device 2 according to the present embodiment, the LED 217 is turned on when the client device 2 is in the away mode to indicate the user's absence.

The communication I/F 221 performs communication via the home network, and receives data transmitted to the client device 2 via the home network. The communication I/F 221 converts the received data into data of a format which can be processed by the client device 2, and supplies the converted data to the DSP 222 if the converted data is music data and to the controller 200 if the converted data is control data for the client device 2.

The communication I/F 221 also converts other data supplied from the controller 200, e.g., a transmission request for music data to be transmitted to the server device 1 and the picked-up sound that is picked up by the client device 2 and that is to be transmitted to the server device 1, described in detail below, into data of a format which can be transmitted via the home network, and transmits the converted data to the target device via the home network. The communication I/F 221 performs such communication via the home network.

The DSP 222 is an audio signal processor for decoding or decompressing music data received from the server device 1 via the communication I/F 221 and separating it into two-channel (right and left) audio data according to the information added to the header to produce left-channel audio data and right-channel audio data for reproduction by performing various types of audio signal processing. Then, the DSP 222 supplies the left-channel audio data to the D/A converter 223(L) and the right-channel audio data to the D/A converter 223(R).

The DSP 222 also encodes sound data (digital data) received from the A/D converters 224(L) and 224(R) according to a predetermined compression method, and supplies the encoded audio data to the communication I/F 221, described below.

As shown in FIG. 3, the client device 2 according to the present embodiment includes two-channel (right and left) speakers R and L. The speakers L and R are used as both sound-output devices and sound-pickup devices. In the client device 2 according to the present embodiment, the speakers L and R have both a sound-output function and a sound-pickup function, and these functions are switched depending upon the presence or absence of the user.

Switch circuits SWL and SWR are used to switch the speakers L and R between the sound-output function and the sound-pickup function, respectively. The switch circuits SWL and SWR are switched to a connection terminal a when the speakers L and R are used as sound-output devices, and are switched to a connection terminal b when the speakers L and R are used as sound-pickup devices.

The switching operations of the switch circuits SWL and SWR are controlled by the controller 200. Specifically, when the absence button 215 is not turned on and when the user's absence is not determined by the human sensor 214, that is, when the user is in the room, the switch circuits SWL and SWR are switched to the connection terminal a.

In this case, as described above, the left-channel and right-channel audio data of the music data received from the server device 1 via the communication I/F 221, which are produced by the DSP 222, are supplied to the D/A converter 223(L) and the D/A converter 223(R), respectively. The D/A converters 223(L) and 223(R) convert the supplied digital audio data into analog audio signals, and output the analog audio signals.

The analog audio signal from the D/A converter 223(L) is supplied to the speaker L via the switch circuit SWL, and sound corresponding to the left-channel audio data is output from the speaker L. Likewise, the analog audio signal from the D/A converter 223(R) is supplied to the speaker R via the switch circuit SWR, and sound corresponding to the right-channel audio data is output from the speaker R.

When the absence button 215 is turned on or when the user's absence is determined by the human sensor 214, that is, when the user is out of the room, the switch circuits SWL and SWR are switched to the connection terminal b. In this case, the speakers L and R are used as sound-pickup devices.

The speaker L serving as a sound-pickup device converts picked-up sound into an electrical signal, and supplies the electrical signal to the A/D converter 234(L). Likewise, the speaker R serving as a sound-pickup device converts picked-up sound into an electrical signal, and supplies the electrical signal to the A/D converter 234(R). The A/D converters 234(L) and 234(R) convert the supplied analog sound signals into digital sound data, and supply the converted sound data to the DSP 222. As described above, the DSP 222 performs processing, such as compression, on the sound data from the A/D converters 234(L) and 234(R), and transmits the resulting sound data to the server device 1 via the communication I/F 211.

As described above, the server device 1 receives and analyzes the picked-up sound (digital data) from the client device 2 to detect an abnormality. If an abnormality is detected, the abnormality is reported to a certain destination such as a pre-registered portable telephone terminal of the user.

In the client device 2 according to the present embodiment, when the absence button 215 is turned on or when the user's absence is determined by the human sensor 214, as described above, the switch circuits SWL and SWR are switched to the connection terminal b to change the mode to the away mode, and the controller 200 controls the LED driver 216 to turn on the LED 217 to indicate the away mode. This allows the user to know that the speakers L and R function as sound-pickup devices, or microphones, in order to avoid violation of privacy involved with sound pickup.

The switch circuits SWL and SWR are normally in the home mode, and are switched to the connection terminal a. However, when the client device 2 is powered on and off, in order to prevent a click noise from the speakers L, and R, the switch circuits SWL and SWR are switched to the connection terminal b for a short time even in the home mode.

The client device 2 according to the present embodiment therefore functions as an audio reproduction apparatus operable to produce audio corresponding to the audio data from the server device 1 when the user is in the room, and functions as a monitoring apparatus operable to pick up sound and to transmit the picked-up sound to the server device 1 to detect any abnormality when the user is out of the room.

The operation of the home network system shown in FIG. 1 according to the present embodiment, which is formed of the server device 1 shown in FIG. 2 and the client device 2 shown in FIG. 3, will be described in terms of the individual operations of the server device 1 and the client device 2.

Figure 4:
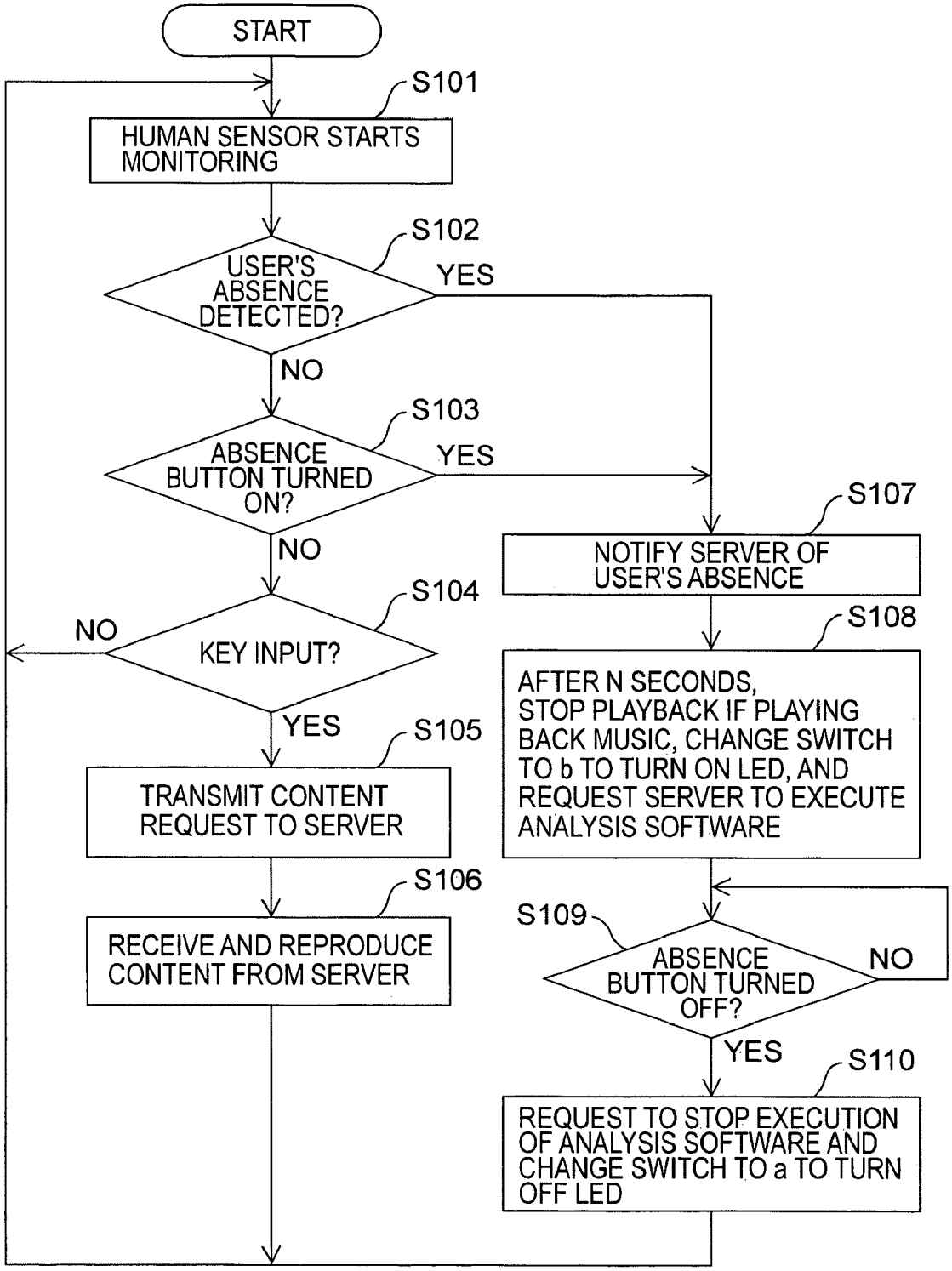
FIG. 4 is a flowchart showing the operation of the client device 2.

FIG. 4 is a flowchart showing the operation of the client device 2 according to the present embodiment. When the client device 2 is powered on, the controller 200 executes the process shown in FIG. 4. In general, since the user is not out of the room when the client device 2 is powered on, the client device 2 is in the home mode, and the switch circuits SWL and SWR of the client device 2 are switched to the connection terminal a. Then, the controller 200 controls the human sensor 214 to determine whether the user is in the room or out of the room (step S101).

The controller 200 determines whether or not the user's absence is determined by the human sensor 214 (step S102). Specifically, if the user's absence is detected by the human sensor 214 and the user has not returned after a predetermined period of time (that is, when the duration of the user's absence is beyond the predetermined period of time), the controller 200 determines that the user is out of the room.

If the presence of the user is determined in step S102, the controller 200 determines whether or not the absence button 215 is in the on state (step S103). If it is determined in step S103 that the absence button 215 is not in the on state, the controller 200 determines whether or not a key input (or an operation input) for requesting music data (content) to be reproduced has been received through the key operation unit 212 (step S104).

If it is determined in step S104 that the key input for requesting music data to be reproduced has not been received, the controller 200 repeatedly performs the processing from step S101. If it is determined in step S104 that the key input for requesting music data to be reproduced has been received, the controller 200 generates a request for the music data instructed by the user, and transmits the request to the server device 1 via the communication I/F 211 (step S105).

The music data transmitted from the server device 1 in response to the music data request transmitted in step S105 is received via the communication I/F 211, as described above, and is then supplied to the speakers L and R via the DSP 222, the D/A converters 223(L) and 223(R), and the switch circuits SWL and SWR to output music (audio) corresponding to the music data from the server device 1 from the speakers L and R (step S106). Then, the processing from step S101 is repeatedly performed.

For ease of illustration, although not shown in FIG. 4, if the user key input received in step S104 includes an instruction to stop playback of music data or to adjust the sound volume, the processing in accordance with the key input from the user is executed, in place of the processing of steps S105 and S106.

If it is determined in step S102 that the duration of the user's absence is beyond the predetermined period of time using the human sensor 214 or if it is determined in step S103 that the absence button 215 is in the on state, the controller 200 notifies the server device 1 of the user's absence via the communication I/F 211 and the home network (step S107). Thus, the server device 1 recognizes that the client device 2 is switched to the away mode, and is ready for analysis of the picked-up sound.

In the client device 2 according to the present embodiment, after the client device 2 is activated in the home mode, the client device 2 is switched to the away mode when the user (or listener) presses the absence button 215 to turn on the absence button 215 when he/she leaves the room or when it is automatically detected using the human sensor 214 that the user has not returned after a preset period of time.

After N seconds have elapsed since the controller 200 notified the server device 1 of the user's absence, if the music data distributed from the server device 1 is being played back, the controller 200 stops playback of the music data. The controller 200 also switches the switch circuits SWL and SWR to the connection terminal b to turn on the LED 217 to change the mode to the away mode, and transmits a request to execute analysis (analysis software) of the picked-up sound to the server device 1 (step S108).

In step S108, the controller 200 waits for N seconds to elapse after it notifies the server device 1 of the user's absence because it may take some time for the user to leave the room after he/she turns on the absence button 215. For example, the controller 200 waits for about 5 seconds to about several minutes. This period of time can be set by the user.

The processing of step S108 causes the client device 2 to be switched to the away mode, in which the sound picked up by the speakers L and R is transmitted to the server device 1 to initiate an audio monitoring operation. After the processing of step S108, the away mode in which sound is picked up is not cancelled even if the user returns after a certain period of time. In order to listen to music, as described below, the user manually turns off the absence button 215 to switch the switch circuits SWL and SWR to the connection terminal a, and gives a request from key input. The client device 2 may automatically be returned from the away mode to the home mode by, for example, determining that the user returns based on a detection output of the human sensor 214.

The controller 200 of the client device 2 maintains the away mode to perform the audio monitoring operation until the user returns and presses the absence button 215 to turn off the absence button 215 (step S109). If it is determined in step S109 that the absence button 215 is in the off state, the controller 200 generates a request to stop execution of the analysis software, and transmits the request to the server device 1. The controller 200 also switches the switch circuits SWL and SWR to the connection terminal a to switch the client device 2 to the home mode (step S110), and repeatedly performs the processing from step S101.

In the client device 2 according to the present embodiment, as described above, the switch circuits SWL and SWR are switched to the connection terminal b when the client device 2 is powered on in order to prevent a click noise from the speakers L and R, and after one second the switch circuits SWL and SWR are switched to the connection terminal a. The LED 217 is in the off state indicating that the client device 2 is in the home mode.

Figure 5:
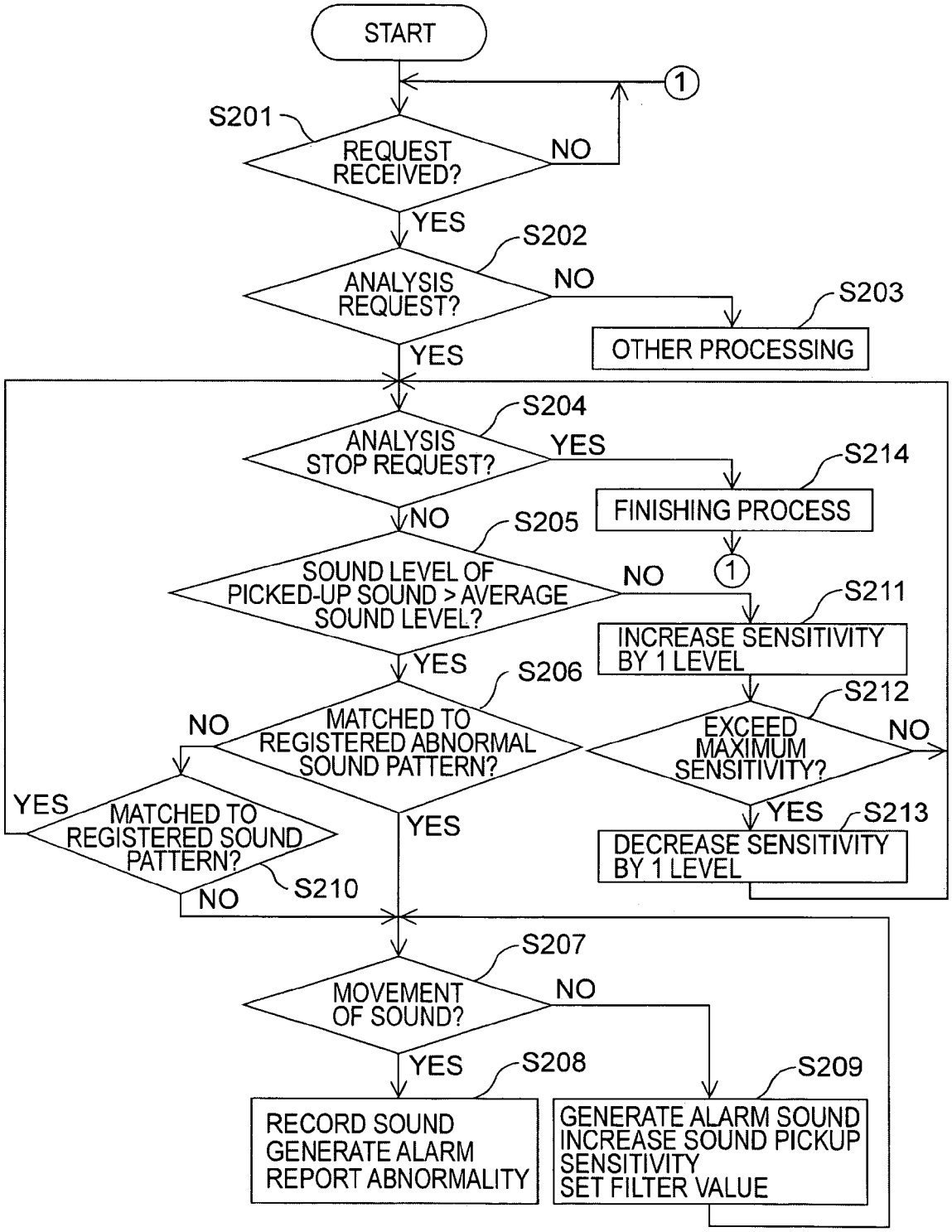
FIG. 5 is a flowchart showing the operation of the server device 1.

The operation of the server device 1 in response to a request from the client device 2 will be described. FIG. 5 is a flowchart showing the operation of the server device 1. When the server device 1 is powered on, the controller 100 executes the process shown in FIG. 5. The controller 100 of the server device 1 stands by until it receives a request from the client device 2 (step S201).

If it is determined in step S201 that a request from the client device 2 has been received, it is determined whether or not the received request is an analysis request for the picked-up sound (step S202). If it is determined in step S202 that the request received from the client device 2 is not an analysis request for the picked-up sound, other processing in accordance with the received request, e.g., distribution of music data or stopping distribution, is executed (step S203).

If it is determined in step S203 that the request received from the client device 2 is an analysis request for the picked-up sound, the controller 100 determines whether or not an analysis stop request has been received (step S204). If it is determined in step S204 that the analysis stop request has not been received, sound data of the picked-up sound sequentially transmitted from the client device 2 is received, and it is determined whether or not the level of the received picked-up sound is higher than a predetermined average sound level (step S205).

If it is determined in step S205 that the level of the picked-up sound is higher than the average sound level, it is determined whether or not the pattern of the picked-up sound is matched to any pre-registered abnormal sound pattern (step S206). If it is determined in step S206 that the pattern of the picked-up sound is completely matched to or is similar to some extent to any pre-registered abnormal sound pattern, it is determined that both patterns are identical. The pre-registered abnormal sound patterns include patterns (frequencies, levels, etc.) of sounds that should not appear when the room is unoccupied, such as the sound of breaking glass, the sound of a person walking, and the sound of a door opening.

If it is determined in step S206 that the pattern of the picked-up sound is identical to any pre-registered abnormal sound pattern, a movement of the sound is checked for (step S207). As described above, the client device 2 according to the present embodiment includes the two-channel (right and left) speakers R and L. For example, if the level of the picked-up sound having the same sound pattern decreases in the right channel and increases in the left channel, it is determined that the picked-up sound moves from left to right. Thus, a movement of the picked-up sound can relatively easily be checked for using multi-channel audio processing systems.

If it is determined in step S207 that a movement of the picked-up sound is detected, the controller 100 records the transmitted picked-up sound in, for example, the HDD 114, and generates an alarm by, for example, radiating alarm sound or turning on the LED 217. The controller 100 also reports the abnormality to a pre-registered destination (step S208). The server device 1 may generate an alarm, or the server device 1 may control the client device 2 so that the client device 2 generates an alarm.

If no movement of the picked-up sound is determined in step S207, there are possibilities of low sound pickup sensitivity of the speakers L and R, a low setting value of a sound-pickup filter, etc., and a process to increase the sound pickup sensitivity or to change the value of the sound-pickup filter is performed (step S209). Then, the processing from step S207 is repeatedly performed.

If it is determined in step S206 that the pattern of the picked-up sound is not identical to any pre-registered abnormal sound pattern, the controller 100 determines whether or not the pattern of the picked-up sound is matched to any registered non-abnormal sound pattern that is a pattern of sounds that can appear in an ordinary state, such as the sound of vehicles traveling on a street or the sound of a doorbell ringing (step S210).

If it is determined in step S210 that the pattern of the picked-up sound is identical to any registered non-abnormal sound pattern, the controller 100 determines that there is no abnormality, and repeatedly performs the processing from step S204. If it is determined in step S210 that the pattern of the picked-up sound is not identical to any registered non-abnormal sound pattern, the controller 200 repeatedly performs the processing from step S207.

If it is determined in step S205 that the level of the picked-up sound is not higher than the average sound level, the controller 100 generates control information for increasing the sound pickup sensitivity by one level, and transmits the control information to the client device 2 to increase the sound pickup sensitivity (step S211). Then, it is determined whether or not the sound pickup sensitivity exceeds the upper limit (step S212). If it is determined that the sound pickup sensitivity does not exceed the upper limit, the processing from step S204 is repeatedly performed. If it is determined in step S212 that the sound pickup sensitivity exceeds the upper limit, the sound pickup sensitivity is reduced by one level (step S213), and the processing from step S204 is repeatedly performed.

If it is determined in step S204 that the analysis stop request has been received from the client device 2, the controller 100 performs a finishing process to stop analysis of the picked-up sound (step S214). Then, the processing from step S201 is repeatedly performed.

Accordingly, the cooperation between the client device. 2 and the server device 1 provides a monitoring system when the user is away from home. Specifically, if the user's absence is detected by the client device 2, which is designed to play music in a room in a house, through the absence button 215 or the human sensor 214, the function of the speakers L and R is switched from the sound-output mode to the sound-pickup mode, and the picked-up sound is transmitted to the server device 1 for analysis. Thus, a monitoring system, or a home security system, can be established.

Merely by adding an analysis program for the picked-up sound or a program for taking measures against the occurrence of abnormality, which is to be mainly executed by the server device 1, an audio security system can be established without adding a hardware component. Like the embodiment described above, two or more speakers located typically are used to separately pick up sound, which is advantageous in that the direction in which the sound moves can be determined without increasing the cost.

In the embodiment described above, the abnormal sound patterns, etc., are registered in advance. However, the present invention is not limited to this embodiment. The apparatus placed in a house for picking up abnormal sounds is also used to pick up and store ordinary sounds throughout the year when the house is empty, and the picked up sounds are classified into a plurality of sound patterns. Thus, both the abnormal sound patterns and the normal sound patterns can be obtained. Sound types, levels, etc., are learned through the year.

The difference between sound in the daytime and sound in the nighttime, the difference between noise through the summer and noise through the winter, etc., are stored. The detection error rate of abnormal sound becomes low as the apparatus is installed for a long time. The stored data, such as the difference in sound type and level between the sounds picked up in the individual rooms and the correlation of these rooms, is constantly updated. The movement of sound is checked for based on the up-to-date data.

It is more effective to place a plurality of sound-pickup devices inside and outside the house in order to differentiate between sounds produced inside and outside the house. For example, an entrance intercom system may be used as a sound-pickup device outside the house. Family voices are registered when the families are at home, thus making it possible to determine whether or not a person who gives an utterance of "I'm home" or the like when he/she comes home is a family. Then, the security mode can automatically be canceled, if appropriate.

Accordingly, utilizing the ability of speakers to serve as sound-pickup devices allows a low-cost, high-reliability home security system to be established by using speakers as sound-pickup devices when the user is away from home.

Modifications

In the foregoing embodiment, when an abnormality is determined by analyzing the picked-up sound from the client device 2, the picked-up sound is recorded in, for example, the HDD 114, and an alarm is generated. Moreover, the abnormality is reported to a predetermined destination. However, the present invention is not limited to this embodiment.

When an abnormality is detected, the picked-up sound may be recorded although an alarm is not generated or the abnormality is not reported to a predetermined destination. Alternatively, when an abnormality is detected, the abnormality may be reported to a predetermined destination, and the picked-up sound may also be transmitted to the. predetermined destination in response to a request from a user so that the picked-up sound can be monitored on the client device 2.

When an abnormality is detected, a warning sound may be generated from another client device to determine whether or not the position at which the abnormal sound is produced has moved in response to the generated warning sound. For example, when abnormal sound is produced by an intruder, the intruder may respond to a warning sound generated by another client device by taking an action and thus making a noise. Thus, more reliable abnormality detection can be performed.

When the controller 100 of the server device 1 analyzes the picked-up sound received via the communication I/F 113 and detects abnormal sound, the controller 100 generates and sends a sound output request to a predetermined client device, e.g., a client device placed in a living room or a client device in a room adjacent to the room in which the client device that picked up the highest level of abnormal sound.

When the client device 2 receives the sound output request, the controller 200 controls the switch circuits SWL and SWR to be switched to the connection terminal a, and supplies the sound corresponding to the audio data distributed from the server device 1 or the audio data stored in the EEPROM 204 or the like to the speakers L and R via the DSP 222, the switch circuits SWL and SWR, and the D/A converters 223(L) and 223(R) to output sound.

The output sound is, for example, a warning sound or a human voice saying "Who is there?" The client devices other than the client device that has received the sound output request are maintained in the away mode and continuously pick up sound and transmit the picked-up sound to the server device 1. If the abnormal sound moves in response to the generated warning sound, there is a possibility of a suspicious intruder, and the user can take appropriate measures. For example, the user can report the suspicious intruder to a security company or the police.

In the client device that has received the sound output request, the switch circuits SWL and SWR are switched to the connection terminal b, for example, several seconds after the sound is output.

In the home network system, therefore, when an abnormality is detected, a speaker of any of the client devices is used as a sound-output device, and speakers of the other client devices are used as sound-pickup devices, thus improving the accuracy in detection of abnormalities.

The client device 2 further includes a clock circuit (not shown), and records the time at which an abnormality is detected together with the picked-up sound.

In the foregoing embodiment, an abnormality is detected based on the level value of the picked-up sound, by performing pattern matching between the picked-up sound and pre-registered sound, and by checking for a movement of the picked-up sound. The picked-up sound may be analyzed using any one of these methods or using any other information.

As described above, the client device 2 includes right and left audio channels. The home network system can self-check for its operation by separately controlling these audio channels.

Figure 6:
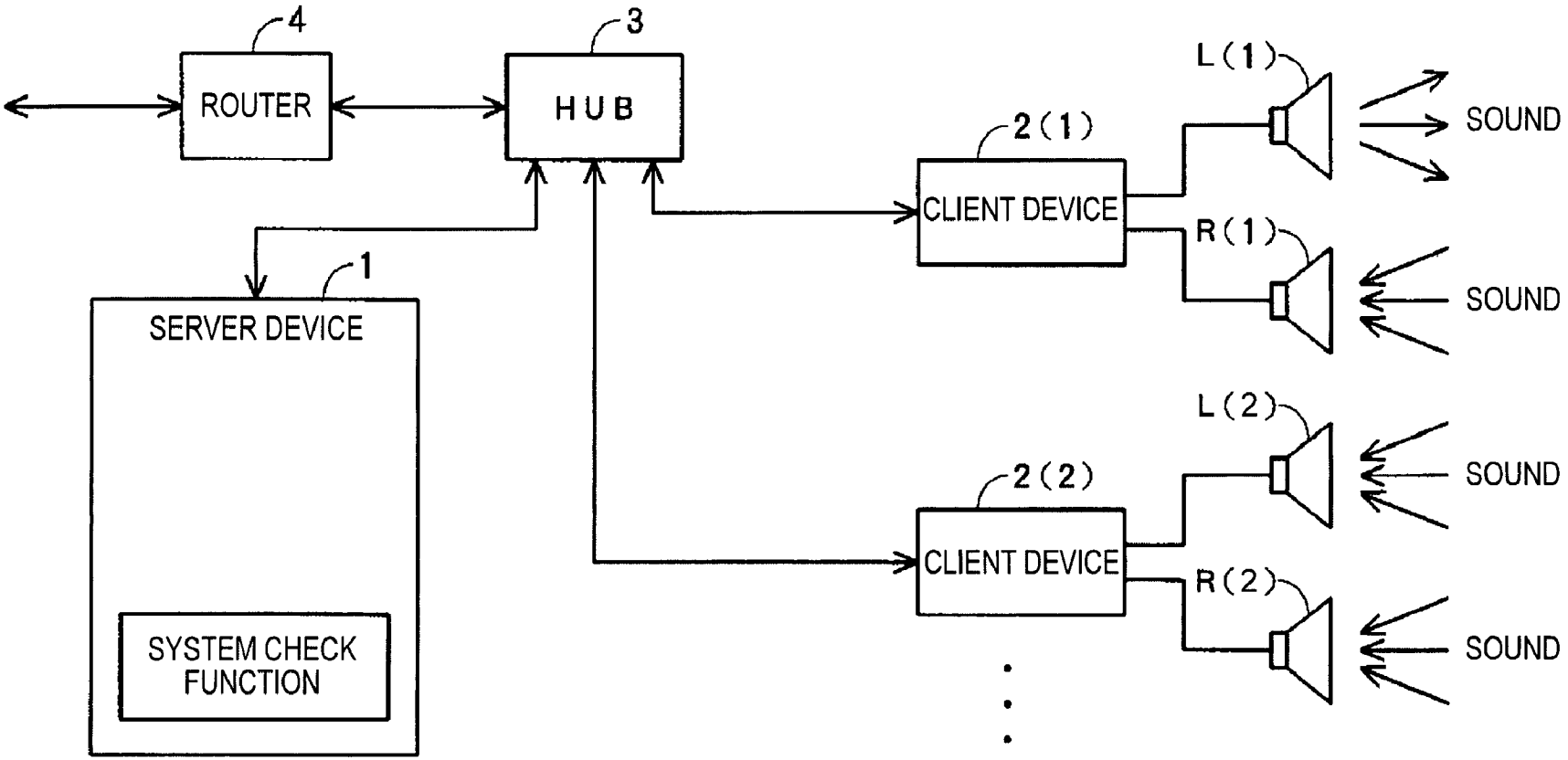
FIG. 6 is a schematic diagram of a system check mechanism.

FIG. 6 shows a mechanism for self-checking for the sound-output function and the sound-pickup function. As described with reference to FIG. 3, the controller 200 of the client device 2 separately controls the switch circuits SWL and SWR. As shown in FIG. 6, for example, the switch circuit SWL corresponding to the left speaker L(1) of the client device 2(1) is switched to the connection terminal a to output predetermined sound from the left speaker L(1) of the client device 2(1), and the other speakers are used as sound-pickup devices for picking up the sound from the speaker L(1).

If the sound output from the left speaker L(1) is picked up at a predetermined level by the speakers other than the left speaker L(1) of the client device 2(1), it is determined that the home network system correctly operates. If there is any speaker that cannot pick up sound, it is determined that the channel system having this speaker contains a failure. If no speaker picks up the sound from the left speaker L, it is determined that the speaker L(1) serving as a sound-output device fails or all speakers except for the speaker L(1) fail.

In the example shown in FIG. 6, a system check is performed on a system including the client devices 2 placed in different rooms. In the following description, for ease of illustration, a self-check is performed on a client device basis, by way of example.

Figure 7:
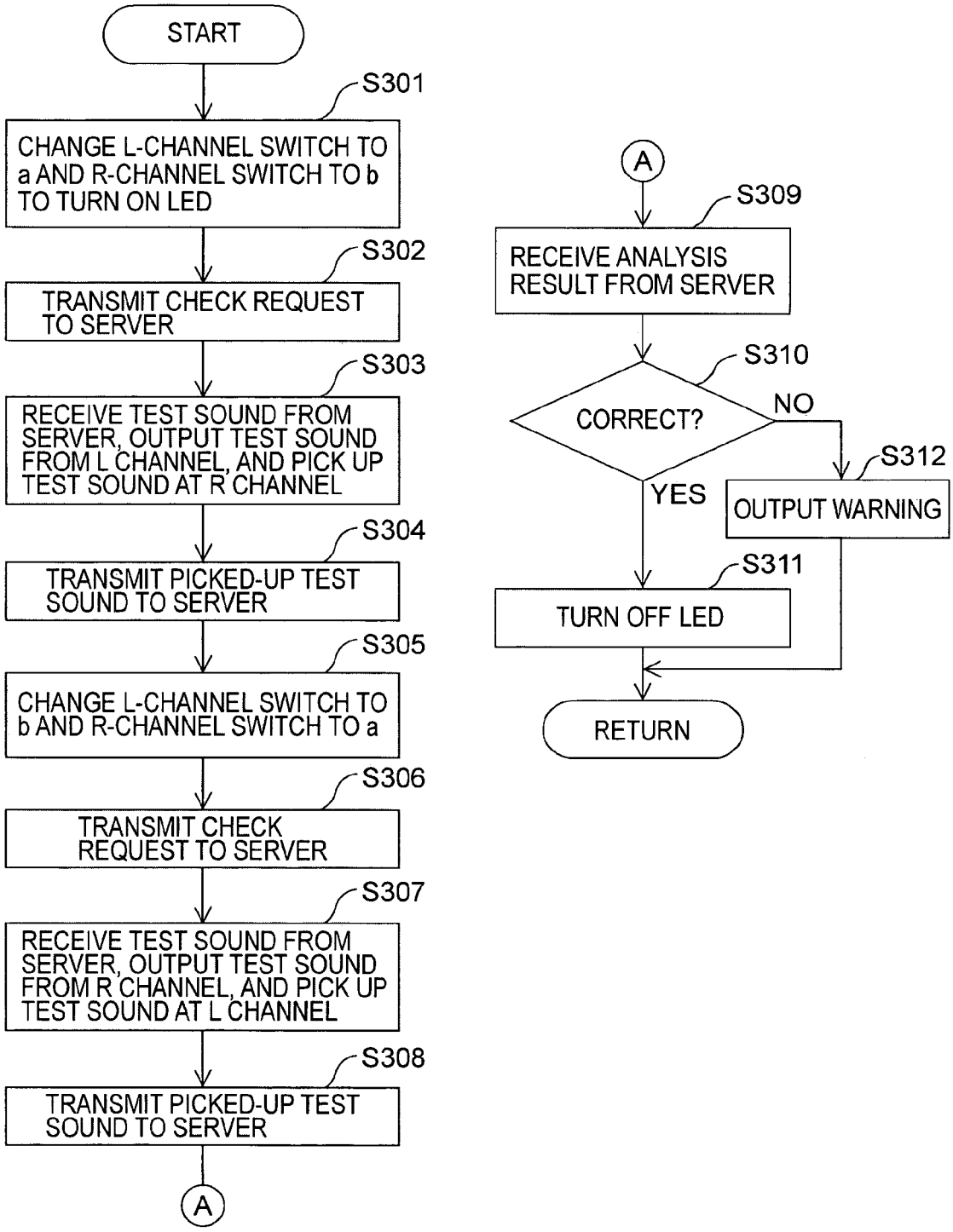
FIG. 7 is a flowchart showing a system check (self-check) routine executed by the client device 2.
Figure 8:
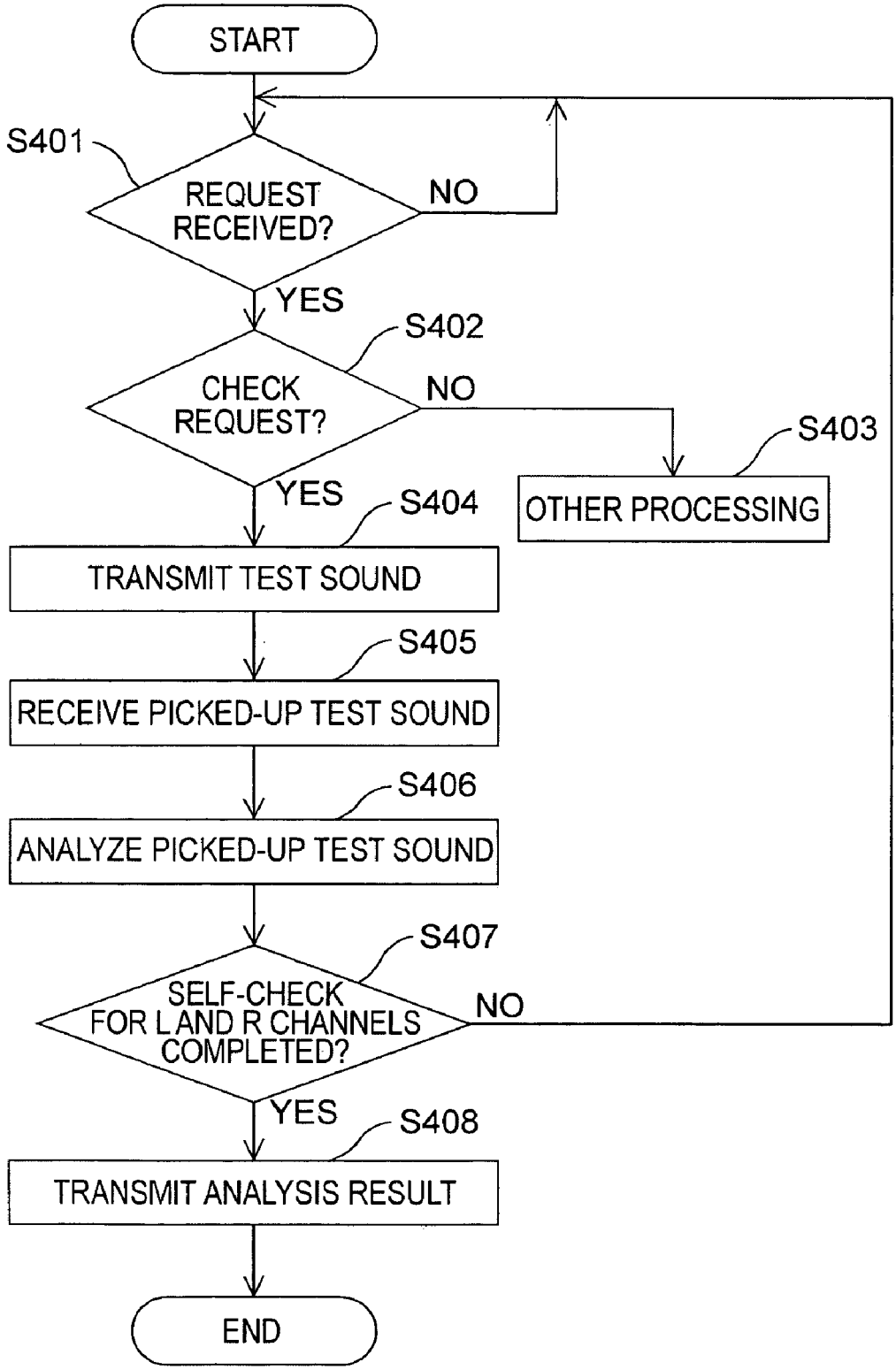
FIG. 8 is a flowchart showing a system check routine executed by the server device 1 when the client device executes the self-check routine.

FIGS. 7 and 8 are flowcharts showing a process for self-checking for speakers on a client device basis. FIG. 7 is a flowchart showing a system check routine performed by the client device 2, and FIG. 8 is a flowchart showing a system check routine performed by the server device 1.

First, the self-check operation of the client device 2 will be described. When execution of a self-check process is instructed through the key operation unit 212 of the client device 2, the controller 200 of the client device 2 executes the routine shown in FIG. 7. First, the controller 200 switches the L-channel switch circuit SWL to the connection terminal a and the R-channel switch SWR to the connection terminal b, and controls the LED driver 216 to turn on the LED 217 to indicate a self-check operation in progress (step S301). The processing of step S301 causes the speaker L to function as a sound-output device and the speaker R to function as a sound-pickup device.

The controller 200 generates a check request for the server device 1 to execute a self-check, and transmits the request to the server device 1 via the communication I/F 221 (step S302). In response to the check request, the server device 1 transmits test sound data to the requesting client device 2. The client device 2 receives the test sound data from the server device 1 via the communication I/F 221, and supplies the test sound signal to the speaker L via the DSP 222, the D/A converter 223(L), and the switch circuit SWL to output test sound from the speaker L, and the output test sound is picked up by the speaker R (step S303).

The test sound picked up by the speaker R is transmitted as digital data to the server device 1 via the switch circuit SWR, the A/D converter 224(R), the DSP 222, and the communication I/F 221 (step S304).

Then, the controller 200 of the client device 2 switches the L-channel switch circuit SWL to the connection terminal b and the R-channel switch SWR to the connection terminal a (step S305). The processing of step S305 causes the speaker L to function as a sound-pickup device and the speaker R to function as a sound-output device.

The controller 200 generates a check request for the server device 1 to execute a self-check, and transmits the check request to the server device 1 via the communication I/F 221 (step S306). In response to the check request, the server device 1 transmits test sound data to the requesting client device 2. The client device 2 receives the test sound data from the server device 1 via the communication I/F 221, and supplies the test sound signal to the speaker R via the DSP 222, the D/A converter 223(R), and the switch circuit SWR to output test sound from the speaker R, and the output test sound is picked up by the speaker L (step S307).

The test sound picked up by the speaker L is transmitted as digital data to the server device 1 via the switch circuit SWL, the A/D converter 224(L), the DSP 222, and the communication I/F 221 (step S308).

The client device 2 receives an analysis result of right and left channels of picked-up sound received and analyzed by the server device 1 (step S309), and checks for the output and pickup operations of the test sound based on the analysis result (step S310). If it is determined in step S310 that the analysis result is correct, the LED driver 216 is controlled to turn off the LED 217 (step S311). Then, the routine shown in FIG. 7 ends.

If it is determined in step S310 that the analysis is not correct, that is, if a failure occurs, e.g., the level of the picked-up test sound is greatly low or no test sound has been picked up, a warning is output (step S312). Then, the routine shown in FIG. 7 ends. In step S312, for example, the LED 217 is flashed, an error message is displayed on an LCD (not shown), or a warning sound is output from a buzzer (not shown).

The operation of the server device 1 when the client device 2 executes a self-check will specifically be described with reference to the flowchart shown in FIG. 8.

After the server device 1 is powered on, the server device 1 waits for a request from the client device 2 (step S401). If it is determined in step S401 that a request from the client device 2 has been received, it is determined whether or not the request received from the client device 2 is a self-check request (step S402).

If it is determined in step S402 that the received request is not a self-check request, other processing in accordance with the received request is executed (step S403). In step S403, for example, when the received request is an audio data transmission request, the requested audio data is read from the HDD 115 and is then transmitted.

If it is determined in step S402 that the received request is a self-check request, the controller 100 of the server device 1 transmits test sound data to the requesting client device 2 (step S404). The picked-up test sound transmitted from the requesting client device 2 is received (step S405), and is analyzed (step S406).

The controller 100 of the server device 1 determines whether or not a self-check for the two (right and left) channels is completed (step S407). If it is determined in step S407 that a self-check for the two (right and left) channels is not completed, the controller 100 repeatedly performs the processing from step S401, and waits for a self-check request for the other channel to be transmitted to perform similar processing on the other channel.

If it is determined in step S407 that a self-check for the two (right and left) channels is completed, analysis results of the two (right and left) channels are transmitted to the requesting client device 2 (step S408). Then, the routine shown in FIG. 8 ends.

Based on self-check results reported (or output) from the server device 1 by executing the routines shown in FIGS. 7 and 8, a failure in the sound-output function or the sound-pickup function of the client device 2 can be recognized by the user of the client device 2. Then, the user further checks for a failure in the cable connection, defects, etc., and takes appropriate measures.

The routines shown in FIGS. 7 and 8 are executed at a desired timing in response to a self-check instruction from the user of the client device 2. Alternatively, the client device 2 may automatically perform a self-check when the user's absence is detected, e.g., when the absence button 215 is turned on.

Figure 9:
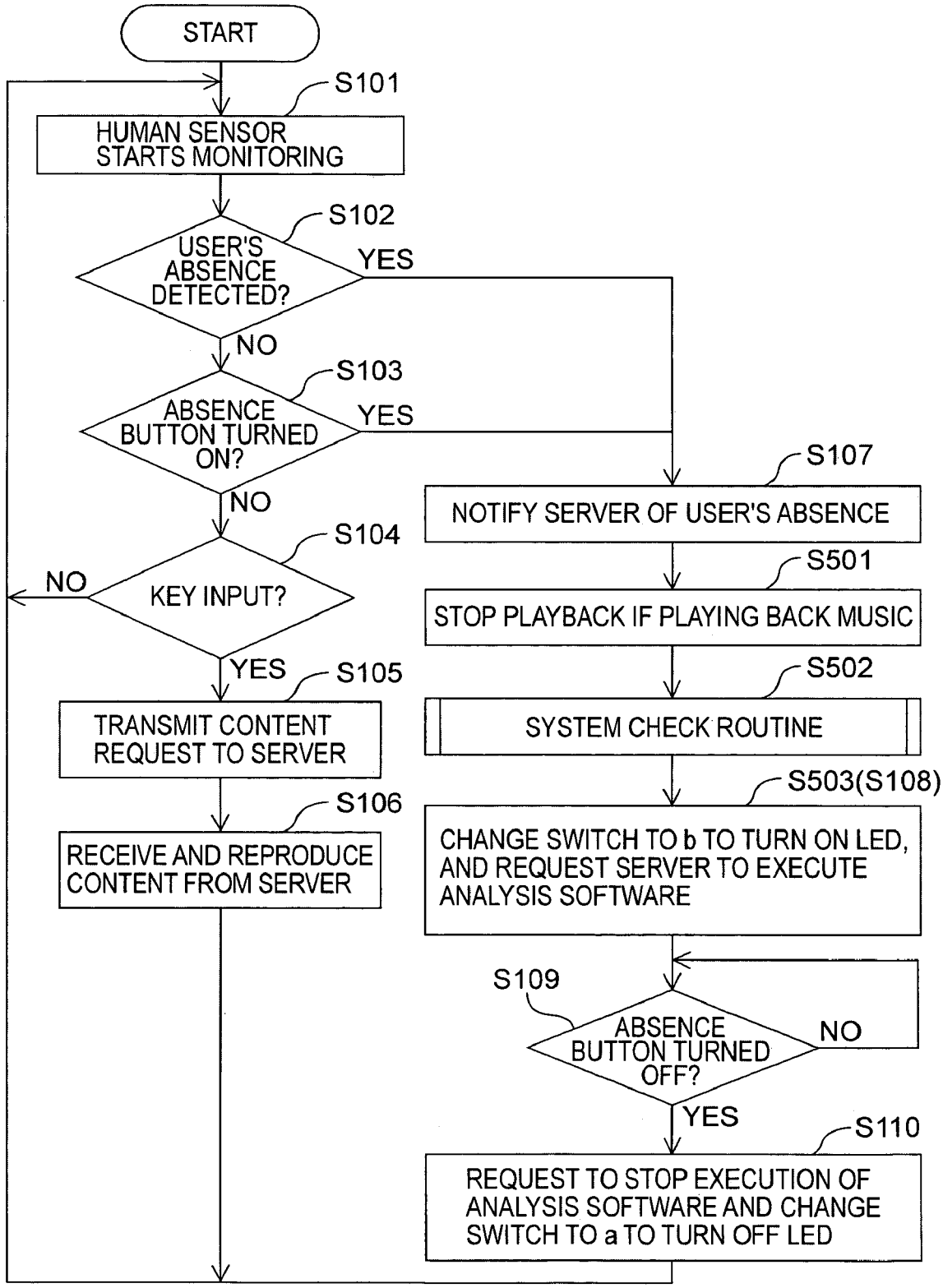
FIG. 9 is a flowchart showing a self-check operation performed by the client device 2 when the mode transitions to an away mode.

FIG. 9 is a flowchart showing an automatic self-check operation performed by the client device 2 when the client device 2 detects the user's absence and transitions to the away mode. Like the flowchart shown in FIG. 4, the flowchart shown in FIG. 9 shows a basic process (operation) to be performed when the client device 2 is powered on.

In the process shown in FIG. 9, the steps similar to those in the process shown in FIG. 4 are assigned the same reference numerals (step numbers), and a description thereof is omitted. In the flowchart shown in FIG. 9, as can be seen from comparison with the flowchart shown in FIG. 4, the processing from steps S501 to S503 is inserted between the processing of step S107 and the processing of step S109. The processing of step S108 shown in FIG. 4 is divided into the processing of step S501 and the processing of step S503.

If it is determined in step S102 that the user's absence is detected through the human sensor 214 or if it is determined in step S103 that the absence button 215 is turned on, in step S107, the controller 200 of the client device 2 notifies the server device 1 of the user's absence, and is ready for the processing for user's absence. If music data is being played back at this time, playback of the music data is stopped (step S501).

Then, the self-check process (system check routine) shown in FIG. 7 is performed (step S502). The server device 1 performs the process shown in FIG. 8 corresponding to the self-check process performed in step S502, and the client device 2 self-checks for the sound-output function and the sound-pickup function. A failure is reported to the user, if any.

Then, the controller 200 switches the switch circuits SWL and SWR to the connection terminal b, and requests that the server device 1 execute analysis of the picked-up sound. In the away mode, the controller 200 transmits the sound picked up by the speakers L and R to the server device 1 (step S503) to monitor abnormalities using sound.

A system that is designed to always perform a self-check when the mode transitions to the away mode ensures that a failure is checked for before transitioning to the away mode. The system reliability can therefore be improved.

The client device 2 including multiple speakers serving as sound-output and sound-pickup devices can individually check for the sound-output function and the sound-pickup function at a desired timing.

Other Embodiments

In the future, home networks will be introduced indoors and connection terminals will be disposed in individual rooms, like electric outlets. In this case, an application for distributing audio information, such as news and music, from a server device to client devices in the individual rooms (including bathrooms and kitchens) may generally be used.

This allows constant distribution of audio information, such as music and news, with a low sound volume, in the individual rooms, and amuses users. There is no need for distributing audio information to an unoccupied room. As described above, basically, the music playback function (that is, the sound-output function) is disabled by operating an absence button indicating the user's absence or by automatically detecting the user's absence, and transitions to the sound-pickup function. In the sound-pickup function, the audio data (picked-up sound) is transmitted to a server device to analyze an event that occurs in the corresponding room only based on the sound, thereby performing a portion of the home security function.

An audio monitoring system capable of detecting an abnormality using picked-up sound is advantageous over a traditional video monitoring system, such as a monitoring camera system, in that the monitoring function is enabled correctly even in a lightless, dark place and in that the (directionally) dead zone is small and the cost is low.

Since the audio apparatus that does not operate when the user is away from home can be used as a monitoring apparatus when the user is away from home, the audio apparatus can efficiently be utilized and can provide high security when the user is away from home.

Although the embodiment described above employs a single server device 1, the number of server devices is not limited to one, and a plurality of server devices may separately be used. The processing of the server device 1 may be divided into portions and these portions may be performed by the server devices. Alternatively, one of the server devices may be used as a main server, and the other server devices may be used as sub server devices.

The server device 1 is not limited to a server device placed in a house, and may be implemented as an external server device connected to a wide area network, e.g., the Internet. A plurality of server devices inside and outside a house may separately be used.

A plurality of server devices inside and/or outside a house may be shared. For example, the picked-up sound may be transmitted to the plurality of server devices to ensure double or triple protection of data.

While the embodiment described above has been described in the context of a home network system, the present invention is applicable to, for example, a device integrally incorporating the server device 1 and the client device 2, such as a personal computer.

In this application, all processes shown in FIGS. 4, 5, 7, 8, and 9 are executed by a device having both the function of the server device 1 and the function of the client device 2. The device having both the function of the server device 1 and the function of the client device 2 can be used by, for example, a single occupant who lives in a dwelling house having a small number of rooms, such as a studio apartment or flat, to increase the security when he/she is away from home.

In the embodiment described above, the client device 2 processes only audio signals. The present invention is also applicable to a device processing both audio and video, such as a television receiver. The present invention is therefore applicable to a device processing at least audio signals.

In the embodiment described above, the client device 2 serving as a sound-output device and a sound-pickup device has two (right and left) channels. The present invention is also applicable to devices having one-channel and multi-channel audio systems, such as three-channel, four-channel, and 5.1-channel systems.

It should be understood by those skilled in the art that various modifications, combinations, sub-combinations and alterations may occur depending on design requirements and other factors insofar as they are within the scope of the appended claims or the equivalents thereof.

What is claimed is:

1. An audio apparatus comprising:

a converter having a sound-output mode in which the converter functions as a sound-output device for converting a sound signal into an audio output and a sound-pickup mode in which the converter functions as a sound-pickup device for converting an audio input into a sound signal;

control means for switching the converter to the sound-output mode or the sound-pickup mode;

analyzing means for analyzing the sound signal generated by the converter when it is switched to the sound-pickup mode by the control means; and a human sensor for determining a presence of a person in a vicinity of the audio apparatus, wherein the control means switches the converter to the sound-pickup mode when no presence is determining by the human sensor; and alarm means for generating an alarm signal based on an analysis result from the analyzing means.

2. The audio apparatus according to claim 1, further comprising switching means for inputting a mode switching command, wherein the control means switches the converter to the sound-pickup mode after a predetermined period of time when the mode switching command is input by the switching means.

3. The audio apparatus according to claim 1, further comprising:

switching means for inputting a mode switching command; and wherein the control means switches the converter to the sound-pickup mode when a mode switching command is input by the switching means.

4. The audio apparatus according to claim 1, wherein the audio apparatus includes at least one terminal device and a server device that are connected via a communication network, the terminal device including the converter and the control means, the server device including the analyzing means, the terminal device transmits the sound signal generated by the converter that is switched to the sound-pickup mode to the server device via the communication network, and the analyzing means of the server device analyzes the sound signal.

5. The audio apparatus according to claim 1, further comprising notifying means for notifying a user of the converter functioning as a sound-pickup device when the converter is switched to the sound-pickup mode by the control means.

6. The audio apparatus according to claim 1, further comprising communicating means for reporting the alarm signal generated by the alarm means to a predetermined destination.

7. The audio apparatus according to claim 1, further comprising sound recording means for recording the sound signal generated from the converter that is switched to the sound-pickup mode in a recording medium when the alarm means generates an alarm signal.

8. The audio apparatus according to claim 1, wherein the analyzing means analyzes the sound signal by performing at least one of an operation to detect a level of the sound signal generated by the converter, an operation to detect a change in the level of the sound signal, an operation to perform pattern matching between the sound signal and a predetermined sound pattern, and an operation to detect a movement of the sound signal.

9. The audio apparatus according to claim 4, wherein the at least one terminal device includes a plurality of terminal devices, the server device includes output request generating means for generating and transmitting a sound signal request to a designated terminal device of the plurality of terminal devices when the alarm means generates an alarm signal, and the converter is switched to the sound-output mode by the control means when the designated terminal device receives the signal request, and generates a sound output corresponding to sound data supplied from the server device or sound data stored in the designated terminal device.

10. The audio apparatus according to claim 1, wherein the audio apparatus includes a plurality of converters, the control means switches at least one of the plurality of converters to the sound-output mode and switches remaining converters to the sound-pickup mode, and the audio output is generated from the converter switched to the sound-output mode while sound signals are obtained by the converters switched to the sound-pickup mode, thereby checking for a sound-output function and a sound-pickup function of the audio apparatus.

11. A monitoring method using an audio apparatus including at least one converter having a sound-output mode in which a respective converter functions as a sound-output device for converting a sound signal into an audio output and a sound-pickup mode in which the converter functions as a sound-pickup device for converting an audio input into a sound signal, the monitoring method comprising the steps of:

performing a first switching operation to switch the converter to the sound-pickup mode;

analyzing the sound signal generated by the converter:

generating an alarm signal based on an analysis result obtained in the step of analyzing; and determining a presence of a person in a vicinity of the audio apparatus, wherein the converter is switched to the sound-pickup mode in the step of performing a first switching operation when no presence is determined in the step of determining a presence.

12. The monitoring method according to claim 11, further comprising the step of inputting a mode switching command, wherein the converter is switched to the sound-pickup mode in the step of performing a first switching operation after a predetermined period of time when the converter is in the sound-output mode.

13. The monitoring method according to claim 11, further comprising:

inputting a mode switching command, wherein the converter is switched to the sound-pickup mode in the step of performing a first switching operation when the mode switching command is input in the step of inputting.

14. The monitoring method according to claim 11, wherein the audio apparatus includes at least one terminal device and a server device that are connected via a communication network, in the terminal device, the converter is switched to the sound-pickup mode in the step of performing a first switching operation, and the sound signal generated by the converter is transmitted to the server device via the communication network, and in the server device, the sound signal transmitted from the terminal device is received and analyzed in the step of analyzing.

15. The monitoring method according to claim 11, further comprising the step of notifying a user of the converter functioning as a sound-pickup device when the converter is switched to the sound-pickup mode in the step of performing a first switching operation.

16. The monitoring method according to claim 11, further comprising the step of reporting the alarm signal generated in the step of generating an alarm signal to a predetermined destination.

17. The monitoring method according to claim 11, further comprising the step of recording the sound signal generated from the converter that is switched to the sound-pickup mode in a recording medium when an alarm signal is generated in the step of generating an alarm signal.

18. The monitoring method according to claim 11, wherein in the step of analyzing, the sound signal is analyzed by performing at least one of an operation to detect a level of the sound signal generated from the converter, an operation to detect a change in the level of the sound signal, an operation to perform pattern matching between the sound signal and a predetermined sound pattern, and an operation to detect a movement of the sound signal.

19. The monitoring method according to claim 14, wherein the at least one terminal device includes a plurality of terminal devices, and comprising the further steps of:

generating and transmitting a sound signal request from the server device to a designated terminal device of the plurality of terminal devices when an alarm signal is generated in the step of generating an alarm signal;

performing a second switching operation to switch the converter of the designated terminal device to the sound-output mode when the designated terminal device receives the sound signal request; and generating a sound signal corresponding to sound data supplied from the server device or sound data stored in the designated terminal device from the converter.

20. The monitoring method according to claim 11, wherein the audio apparatus includes a plurality of converters, and the monitoring method further comprises the step of performing a second switching operation to switch at least one of the plurality of converters to the sound-output mode, switching remaining converters to the sound-pickup mode in the step of performing a first switching operation, and generating the audio output from the converter switched to the sound-output mode while the sound signals are obtained by the converters switched to the sound-pickup mode, thereby checking a sound-output function and a sound-pickup function of the audio apparatus.

21. An audio apparatus comprising:

a converter having a sound-output mode in which the converter functions as a sound-output device for converting a sound signal into an audio output and a sound-pickup mode in which the converter functions as a sound-pickup device for converting an audio sound into a sound signal;

a controller switching the converter to the sound-output mode or the sound-pickup mode;

an analyzing section analyzing the sound signal generated from the converter that is switched to the sound-pickup mode by the controller; and an alarm section generating an alarm signal based on an analysis result from the analyzing section; and a human sensor which determines a presence of a person in a vicinity of the audio apparatus, wherein the controller switches the converter to the sound-pickup mode when no presence is determined by the human sensor.

22. An audio apparatus comprising:

a converter having a sound-output mode in which the converter functions as a sound-output device for converting sound signal into an audio output and a sound-pickup mode in which the converter functions as a sound-pickup device for converting an audio input into a sound signal;

control means for switching the converter to the sound-output mode or the sound-pickup mode;

analyzing means for analyzing the sound signal generated by the converter when it is switched to the sound-pickup mode by the control means; and alarm means for generating an alarm signal based on an analysis result from the analyzing means, wherein the analyzing means analyzes the sound output signal by performing an operation to detect a movement of the sound signal.

23. The audio apparatus according to claim 22, further comprising switching means for inputting a mode switching command, wherein the control means switches the converter to the sound-pickup mode after a predetermined period of time when the mode switching command is input by the switching means.

24. The audio apparatus according to claim 22, further comprising a human sensor for determining a presence of a person in a vicinity of the audio apparatus, wherein the control means switches the converter to the sound-pickup mode when no presence is determined by the human sensor.

25. The audio apparatus according to claim 22, further comprising:

switching means for inputting a mode switching command; and a human sensor for determining a presence of a person in a vicinity of the audio apparatus, wherein the control means switches the converter to the converter to the sound-pickup mode when no presence is determined by the human sensor or when a mode switching command is input by the switching means.

26. The audio apparatus according to claim 22, wherein the audio apparatus includes at least one terminal device and a server device that are connected via a communication network, the terminal device including the converter and the control means, the server device including the analyzing means, the terminal device transmits the sound signal generated by the converter that is switched to the sound-pickup mode to the server device via the communication network, and the analyzing means of the server device analyzes the sound signal.

27. The audio apparatus according to claim 22, further comprising notifying means for notifying a user of the converter functioning as a sound-pickup device when the converter is switched to the sound-pickup mode by the control means.

28. The audio apparatus according to claim 22, further comprising communicating means for reporting the alarm signal generated by the alarm means to a predetermined destination.

29. The audio apparatus according to claim 22, further comprising sound recording means for recording the sound signal generated from the converter that is switched to the sound-pickup mode in a recording medium when the alarm means generates an alarm signal.

30. The audio apparatus according to claim 22, wherein the analyzing means analyzes the sound output signal by performing in addition to the operation to detect a movement of the sound signal at least one of an operation to detect a level of the sound output signal generated by the converter, an operation to detect a change in the level of the sound signal, or an operation to perform pattern matching between the sound signal and a predetermined sound pattern.

31. The audio apparatus according to claim 26, wherein the at least one terminal device includes a plurality of terminal devices, the server device includes output request generating means for generating and transmitting a sound signal request to a designated terminal device of the plurality of terminal devices when the alarm means generates an alarm signal, and the converter is switched to the sound-output mode by the control means when the designated terminal device receives the signal request, and generates a sound output corresponding to sound data supplied from the server device or sound data stored in the designated terminal device.

32. The audio apparatus according to claim 22, wherein the audio apparatus includes a plurality of converters, the control means switches at least one of the plurality of converters to the sound-output mode and switches remaining converters to the sound-pickup mode, and the audio output is generated from the converter switched to the sound-output mode while sound signals are obtained by the converters switched to the sound-pickup mode, thereby checking for a sound-output function and a sound-pickup function of the audio apparatus.

33. An audio apparatus comprising:

a converter having a sound-output mode in which the converter functions as a sound-output device for converting a sound signal into an audio output and a sound-pickup mode in which the converter functions as a sound-pickup device for converting an audio signal sound into a sound signal;

a controller switching the converter to the sound-output mode or the sound-pickup mode;

an analyzing section analyzing the sound signal generated from the converter that is switched to the sound-pickup mode by the controller; and an alarm section generating an alarm signal based on an analysis result from the analyzing section, wherein the analyzing section analyzes the sound output signal by performing an operation to detect a movement of the sound signal.

34. The audio apparatus according to claim 33, wherein the analyzing section analyzes the sound output signal by performing in addition to the operation to detect a movement of the sound signal at least one of an operation to detect a level of the sound output signal generated by the converter, an operation to detect a change in the level of the sound signal, or an operation to perform pattern matching between the sound signal and a predetermined sound pattern.

* * * * *

UNITED STATES PATENT AND TRADEMARK OFFICE

CERTIFICATE OF CORRECTION

PATENT NO. : 7,317,389 B2
APPLICATION NO. : 11/113874
DATED : January 8, 2008
INVENTOR(S) : Teppei Yokota It is certified that error appears in the above-identified patent and that said Letters Patent is hereby corrected as shown below:

Column 20, line 57, delete the word “and”;

Column 20, after line 57, insert --alarm means for generating an alarm signal based on an analysis result from the analyzing means; and--;

Column 20, line 61, “determining” should read --determined--;

Column 20, line 62, “; and” should read --.--;

Column 20, delete line 63;

Column 20, delete line 64;

Column 21, line 44, “pattern, and” should read --pattern, or--;

Column 22, line 31, “comprising:” should read --comprising--;

Column 23, line 2, “pattern, and” should read --pattern, or--;

Column 23, line 22, “step of” should read --steps of:--;

Column 23, line 46, “controller; and” should read --controller;--;

Column 24, line 24, delete “converter to the”.

Signed and Sealed this

Seventeenth Day of March, 2009

JOHN DOLL
*Acting Director of the United States Patent and Trademark Office*